United States Patent [19]

Carlson et al.

[11] 4,137,596

[45] Feb. 6, 1979

[54] COLLAPSABLE BRUSHES

[75] Inventors: John E. Carlson, Commack; Richard W. Carlson, Stormville, both of N.Y.

[73] Assignee: PDM Consulting and Development Corp., New York, N.Y.

[21] Appl. No.: 710,708

[22] Filed: Aug. 2, 1976

Related U.S. Application Data

[63] Continuation-in-part of Ser. No. 540,994, Jan. 14, 1975, abandoned.

[51] Int. Cl.[2] ..... A46B 9/10

[52] U.S. Cl. ..... 15/203

[58] Field of Search ..... 15/203; 132/119, 121, 132/129, 143

[56] References Cited

U.S. PATENT DOCUMENTS

| | | | |
|---|---|---|---|
| 2,486,203 | 10/1949 | Pieper | 15/203 |
| 2,774,096 | 12/1956 | Taylor | 15/203 |
| 2,792,582 | 5/1957 | Gray | 15/203 |
| 3,977,420 | 8/1976 | Yalof | 15/203 |

*Primary Examiner*—Robert W. Jenkins

*Attorney, Agent, or Firm*—Harold L. Stults

[57] ABSTRACT

A compact portable pocket brush has retractable bristles arrayed in groups attached to a plurality of bristle group holders or supports mounted upon pivot pins in a brush case. The top wall of the case has a plurality of downwardly sloping apertures respectively located in alignment with each bristle group in the brush. The bristle group pivot pins are pivotably mounted upon a slide in the bottom of the case. When the slide is moved between two positions, each bristle group is pivoted between a retracted position in which it is enclosed within the case and an erect position wherein the bristles extend through the openings in the top wall of the case. When in the erect position all of the bristle groups are locked in a rigid vertical position by the engagement between the periphery of the holes and a portion of the bristle group holder so that the brushes can be used.

5 Claims, 8 Drawing Figures

Fig. 1
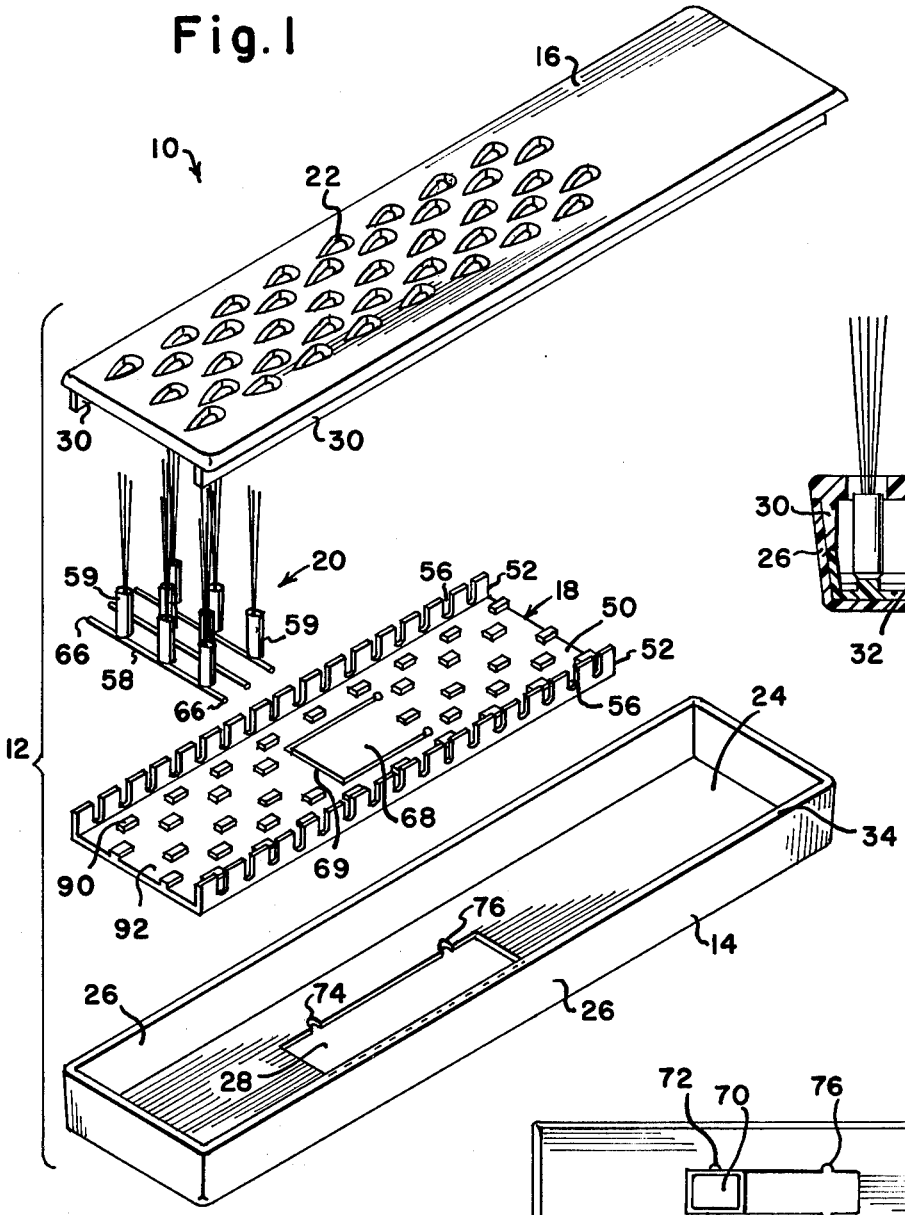
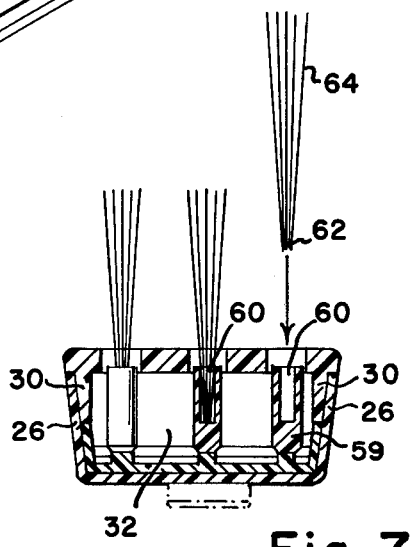
Fig. 7
Fig. 6
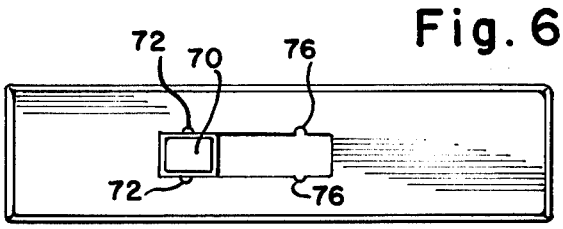
Fig. 2
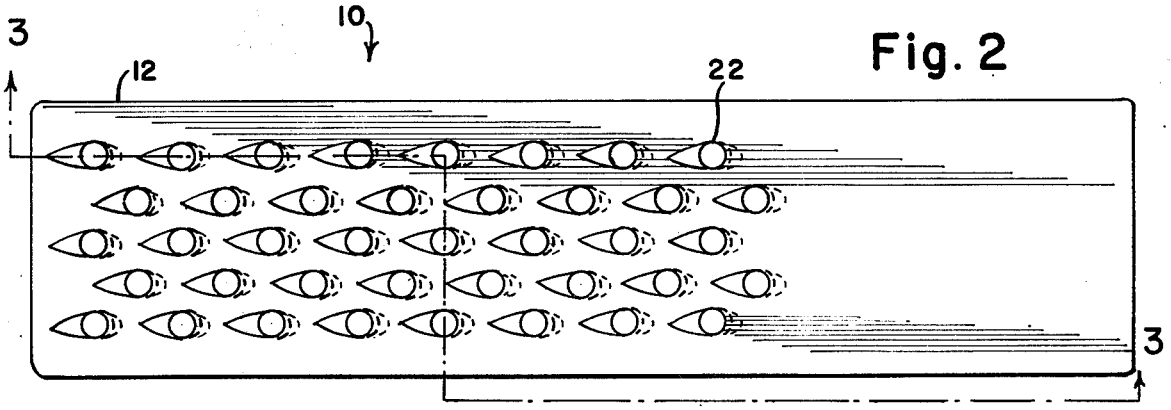

COLLAPSABLE BRUSHES

This application is a continuation in part of our application Ser. No. 540,994, filed Jan. 14, 1975, now abandoned.

The present invention relates to brushes, and more particularly to a compact brush structure adapted to extend and retract in a plurality of normally hidden bristle groups.

Modern day living demands the utilization of a brush for many grooming and hygienic purposes, e.g. care of clothes, hair or teeth. Such utilization is best accomplished by a brush which is not only portable but is also protected against outside contamination when not in use and is easily cleaned after each use. In brushes known to the prior art, several of these desirable characteristics were achieved by causing the bristle groups to be rigidly mounted to a bristle support member with extension and retraction of each row of bristles relative to the bristle support member being accomplished by use of relatively complex mechanisms requiring a multiplicity of components. The large interior volume occupied by this multiplicity of components necessitated that the bristles remain generally exposed to outside contamination and require the use of an additional cover over the brush and periodic cleaning of the bristles to assure a moderate measure of cleanliness.

One previously proposed brush arrangement, shown for example in U.S. Pat. No. 2,486,203, has a brush including retractable bristles in which the bristles, when withdrawn, are contained within a head portion of the brush. In that arrangement, the bristles are exposed to wear during use because of rubbing against the edges of the brush housing, and the bristles will be very flexible during use since they are unsupported. Some support for the bristles can be achieved by using a series of guide plates surrounding the bristles and pivotally mounted within the housing. However such plates will also cause substantial wear on the bristles.

In accordance with the present invention a brush is provided in which the bristles are normally retracted into the brush case to protect against outside contamination when the brush is not in use, while allowing the bristles to be extended to a position generally transverse to the exterior top surface of the brush case, which extension is accomplished by a simple mechanical mechanism utilizing a minimum number of parts, and which arrangement also performs a bristle cleaning operation during the retraction of the bristles into the case.

It is an object of the invention to permit the extension and retraction of bristle groups through the case of a brush.

Another object of the present invention is to provide for such extension and retraction through the use of a simple mechanism requiring a minimum number of parts.

A further object of the invention is to provide a simple bristle extension and retraction mechanism which rigidly maintains the bristle groups in a substantially transverse extended position above the top surface of the brush case.

Another object of the present invention is to provide a bristle self-cleaning feature in such a mechanism.

A still further object of the present invention is to provide a bristle extension and retraction mechanism which provides for rigid support of the bristles and their support members during use of the brush.

In accordance with an aspect of the present invention a brush achieving these goals, while remaining compact and slender enough to be easily carried in a pocket, includes a hollow casing defining an internal cavity and having a top wall along one side of the cavity. The top wall has a predetermined array of openings formed therein, and a slide plate is slidably mounted in the cavity below and spaced from the top wall for sliding movement between first and second positions in the casing. A plurality of brush elements are located in the casing, respectively associated with the openings in the top wall. Each of these brush elements includes a brush or bristle portion having a free tip and an opposed mounting end, and a mounting sleeve or bristle group holder secured to the mounting end of the bristle portion. This mounting sleeve is pivotally mounted on the slide plate for movement therewith.

The brush elements have a central axis and are located on the slide plate in the first position thereof with the portion of their respective mounting sleeves connected to the slide plate offset from their associated openings, with the central axis thereof at an acute angle to the general plane of the top wall and with the free tip ends thereof located within their associated openings in the top wall. In the second position of the slide plate the brush elements are located with the portion of their respective mounting sleeves connected to the slide plate located substantially directly below their associated openings, and the central axis of the brush elements extending generally perpendicularly to the slide plate so that the brush portions thereof extend through the openings in the top wall. In this position a portion of the respective sleeves of the brush elements are located within their associated opening in the top wall. These openings have a predetermined configuration selected to closely surround the sleeves of the brush elements, in the second position of the slide plate, so that the sleeves are supported about their entire periphery when the brush is in its operative position, whereby the brush portions or bristles are protected against wear and rigidly supported closely adjacent the surface of the brush in the manner of a conventional brush having fixed bristles, so that the brush has a natrual feel and action when in use.

The above, and other objects, features and advantages of this invention will be apparent in the following detailed description of an illustrative embodiment thereof, which is to be read in connection with the accompanying drawings, wherein:

FIG. 1 is an exploded perspective view of a brush constructed in accordance with the present invention;

FIG. 2 is a plan view of the brush shown in FIG. 1, in its assembled condition;

FIG. 6 is a back view, on a small scale, of the brush shown in FIGS. 1-5;

FIG. 7 is a sectional view taken along line 7—7 of FIG. 4; and

Figure 3:
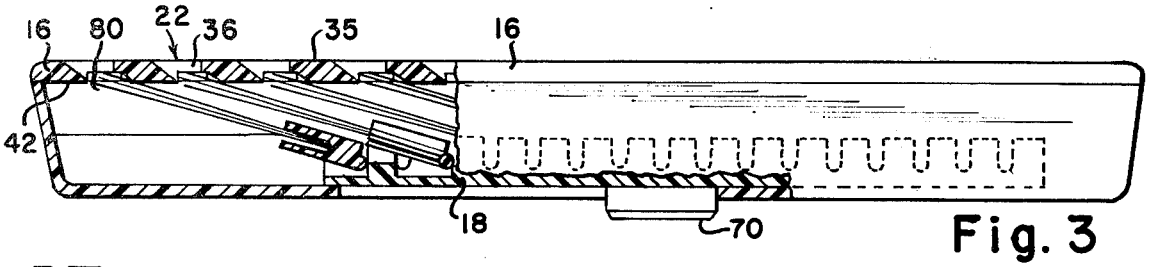
FIG. 3 is a side view, partly in section, taken along line 3—3 of FIG. 2, showing the brush elements in their retracted position.

Referring now to the drawing in detail, and initially to FIGS. 1 and 2 thereof, a brush 10, constructed in accordance with the present invention, includes a hollow casing 12 formed from a base casing element 14, a top wall 16, and an internal carrier or slide plate 18 on which a plurality of brush elements 20 are pivotally mounted so as to allow their extension and retraction through a plurality of openings 22 formed in the top wall 16 of the case.

Case portion 14 is formed as an open boxlike element having an elongated base 24 and side walls 26. Base 24 has a slot or rectangular opening 28 formed therein for cooperating with slide plate 18, as described hereinafter.

Top wall 16 of case 10 has internal downwardly extending flanges 30 formed therein that nest within the walls 26 of casing element 14, as seen in FIG. 7, to form a cavity 32 within the casing. In the completed construction of the brush, top wall 16 is secured to the top edges 34 of casing member 14 by an adhesive or by heat sealing, sonic welding or in any other convenient manner.

Figure 4:
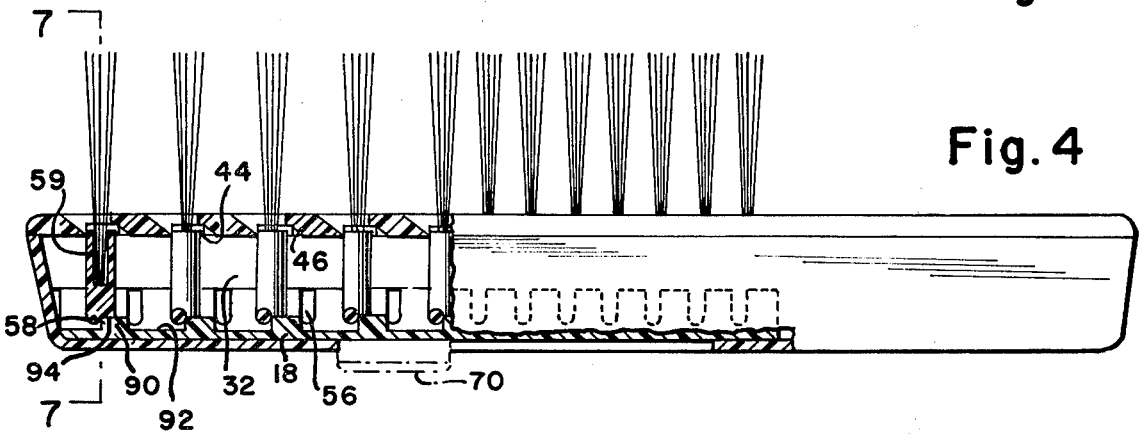
FIG. 4 is a view similar to FIG. 3 showing the extended or erect position of the brush element.
Figure 5:
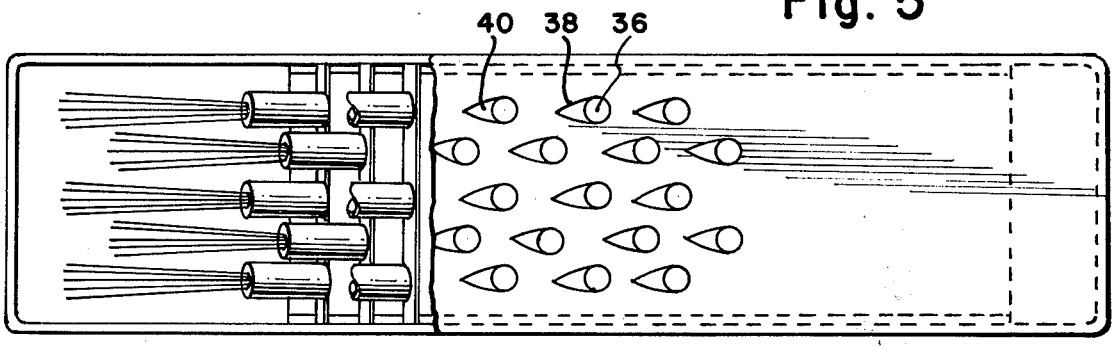
FIG. 5 is a plan view, similar to FIG. 2, but with a portion of the top cover of the brush broken away.

The plurality of apertures 22 formed in top wall 16 are located in rows along a major portion of the length of the brush, in a predetermined array so as to be respectively positioned in association with one of the brush or bristle portions of the brush elements 20. In the illustrative embodiment of the invention shown in FIGS. 1, 3 and 4, apertures 22 have a specially shaped configuration including, on the top surface 35 of top wall 16, a generally semi-circular segment 36 and a tapered edge or segment 38, forming the remainder of the periphery of the respective opening, which extends downwardly at an acute angle with respect to the exterior top surface 35 of top wall 16. Tapered segment 38 of apertures 22 has a curved wall portion 40 which extends downwardly through the entire thickness of the top wall 16 and terminates in a semi-circular edge or segment, as seen in FIGS. 5 and 4, to form a trough-like elongated aperture. The semi-circular segment 36 of the apertures 22 extends only partially downwardly through the thickness of wall 16.

To complete the through aperture 22 of top wall 16, the lower surface 42 of top wall 16 is provided with a circular recess 44 formed therein associated with each of the openings 22. This recess is axially offset slightly from the semi-circular opening segment 36 (see FIG. 4) and is provided with a ramp section 46 that is generally parallel to surface 40, and arcuately shaped in the same manner. Openings 22, shaped in this manner, serve to guide the bristles during movement, and to rigidly support the mounting portion of the brush elements in their erect position.

The carrier or slide plate 18 comprises a flat plate 50 having vertically extending spaced side walls 52. These side walls have upwardly opening slots or apertures 56 formed therein located in transverse alignment with each other. These openings provide for the pivotal mounting of the brush or bristle group holders 20.

Each row of bristle group holders includes an alongated pivot pin or bar 58 and a plurality of bristle element mounting supports or sleeves 59 rigidly secured thereto. Preferably mounting support sleeves 59 are tubular in shape and integrally formed with pivot pin 56 by a plastic molding operation. The sleeves have upwardly opening recesses 60 formed therein which receive the mounting ends 62 of a plurality of bristles or brush elements 64. It is contemplated that in lieu of a plurality of bristle elements received in each of the sleeves 59, an individual tooth or single brush element can be mounted in the sleeve, depending upon the type of brush desired. In any event, the bristles are secured in the sleeves by an adhesive, or in any other convenient manner.

In the presently preferred embodiment of the invention, the bristle or brush groups 20 are provided in two pairs of groups, alternating with each other, with one group having at least one more mounting sleeve on its pivot pin 58 than the rows of the other group. Thus, in the illustrative embodiment of the invention, one bristle group has three mounting sleeves 59 while the adjacent and alternating groups have two. In addition the sleeves in each group are mounted on their respective pivot pins so that they are staggered with respect to one another, as seen in FIG. 5. Thus, in the retracted position of the brush elements as seen in FIG. 5, the adjacent mounting sleeves and bristles or brush elements will interdigitate in a compact relationship.

In the assembled configuration of the brush, the ends 66 of the pivot pins 58 are received in an associated pair of transverse openings 56 in the side walls 52, with the two types of bristle groups alternated with each other in the manner previously described. By this arrangement the bristle groups can pivot from retracted to erect or vertical positions, upon movement of the slide plate.

The pattern formed by the positions of each of the bristle sleeves 59 corresponds to the pattern of apertures 22 in top wall 16, with each of the bristle sleeves being arranged in alignment with the openings 22. In the assembled condition of the brush, as illustrated in FIGS. 3 and 4, slide plate 18 is received within cavity 32 of case element 14, with the bristle groups pivotally mounted thereon. The bristles or brush elements in the sleeves 59 are dimensioned such that in their retracted position illustrated in FIG. 3, their free ends 80 extend into the lower surface 42 of top wall 16 and enter the lower portions of recesses 22. By this arrangement when slide plate 18 is moved from its first position illustrated in FIG. 3 to its second position, as described hereinafter, openings 22 will guide the bristles and cause the bristles and their mounting sleeves to pivot, in a clockwise direction, as seen in the drawing, until the sleeves achieve a vertical position at the second position of plate 18.

Slide plate 18, whose side walls 52 have a height which is slightly less than the height of side walls 26 of case element 14 so that the plate can have a small but limited degree of motion in the vertical direction when positioned within the case, includes a rectangular tang 68 formed by cutting a generally U-shaped channel 69 through the plate between its arms 52, with the arms of the channel parallel to the sides 52 of the slide plate. A finger button 70, having opposed sides parallel to the sides of slot 28, is formed at the free end of the tang. The distance between the parallel sides of button 70 is slightly less than the distance between the parallel sides of slot 28 in base 24 of casing element 14, so that the button protrudes through this slot. The button further includes a pair of opposed abutments 72, each of which is formed to extend a small distance outwardly or transversely from the mid-point of the button sides (see FIG. 6). Slot 28 has a first pair of recesses 74 formed toward one end of the slot and a second pair of recesses 76 formed towards the opposite end of the slot; with each pair of recesses defining respective position of the side plate. When the slide plate is in its first position with abutment 72 engaged in recesses 76, each group of bristles 20, with their associated bristle holders 59, is pivoted in the side walls 52 of the carrier plate to an inclined position wherein the central axis of the bristles forms an acute angle with the top surface of the casing, so that the bristles are retracted, with the free ends of each bristle group being located below the top surface 35 of top wall 16 but within its associated opening 22. When button 70 is pushed inwardly toward the top wall of the case, the engagement of abutment 72 with recesses 76 is released and carrier plate 18 can be slid forwardly to its second position, wherein abutment 72 will engage recesses 74 when button 70 is released. This movement of the carrier plate causes each of the bristle groups and the sleeves 59 thereof to pivot as the bristles slide upwardly along the aperture periphery segment 40, until each bristle holder or sleeve 58 is positioned directly beneath its corresponding aperture 22. In this position each bristle group extends above the exterior top surface 35 of the top wall in a direction essentially transverse thereto. The bristle mounting sleeves 59 are dimensioned to enter the recesses 44 formed on the lower surface 42 of the top wall of the brush, and they have a peripheral configuration which is generally complementary to recesses 44 so that the rigid sleeves are substantially rigidly supported around their periphery by top wall 16. In this manner the individual bristle groups are supported rigidly in their erect position at substantially the level of the top wall in the manner of a conventional fixed bristle brush, so that the brush has the normal feel and action of a conventional brush when in use. At the same time the bristles themselves are protected against wear from rubbing against the edges of openings 22.

While the location of recesses 72 and slot 28 define the second position of carrier plate 18, so as to limit the pivot movement of the bristle groups in a clockwise direction, as illustrated in the drawings, in order to insure that the bristle groups move only to a vertical position carrier plate 18 is provided with a plurality of upstanding seats 90 formed on its top surface 92. Each of these seats is associated with one of the sleeves 59 so as to engage the base 94 of the sleeve when the sleeve is moved to its vertical position. For this reason, and to further aid in a compact positioning of the bristle groups in the retracted position of the brush, sleeves 59 are mounted in an offset position on their pivot pins 56, as seen most clearly in FIGS. 3 and 4. Thus the central axis of the bristle groups is offset from the axis of pivot pins 56, in order to define shoulder 94 on the base of the sleeves. Accordingly, once the sleeves have been pivoted to their vertical position further pivoting in a clockwise direction is prevented. Thus the sleeves are positively held in their erect position in the brush. In this position of course the bottom end of the sleeves 59 are located directly below their associated openings.

When it is desired to retract the brush bristles below the exterior top surface of top wall 16 an inward pressure on button 70 is applied until abutments 72 clear the recesses in the bottom wall of casing element 14, whereupon the button and the attached carrier are slid in an opposite direction towards recesses 76 until the abutments 72 are aligned with and held by the recess pair 76. During this sliding motion the pivot pins 56 of the respective rows of bristles are pulled by the carrier towards the right in FIGS. 3 and 4 of the drawing, forcing the mounting sleeves 59 to pivot in a counterclockwise direction as the bristles are guided by the lower edge of the openings 22, defined by the ramp surface 46. In this manner the free ends of the bristles are withdrawn below the exterior top surface 35 of top wall 16 when the carrier is moved to its second position.

As the bristles are rotated and slid through their associated apertures into the interior of the brush casing, the edges of the aperture periphery segments perform a wiping action on the bristles, thereby performing a bristle cleaning operation during the retraction of the bristles. The extraneous matter cleaned from the bristles is deposited upon the exterior top surface of the brush and may be conveniently wiped away without interference from the now retracted bristles.

As the length of carrier 18 must be less than the interior length of case 10, to allow space into which the carrier may move during the extension and retraction operation, a portion of the top wall of the case, as illustrated in FIGS. 1 and 2, will have no apertures and will never have bristles extending outwardly from its surface. This portion of the case is suited for use as a handle. It should be understood that the length of the case and carrier 18 may be varied and shaped as desired to cause the portion of the case having no apertures and the portion of the carrier having no brush holders or sleeves 59 mounted therein to be whatever length and shape is desired to form the handle portion.

Figure 8:
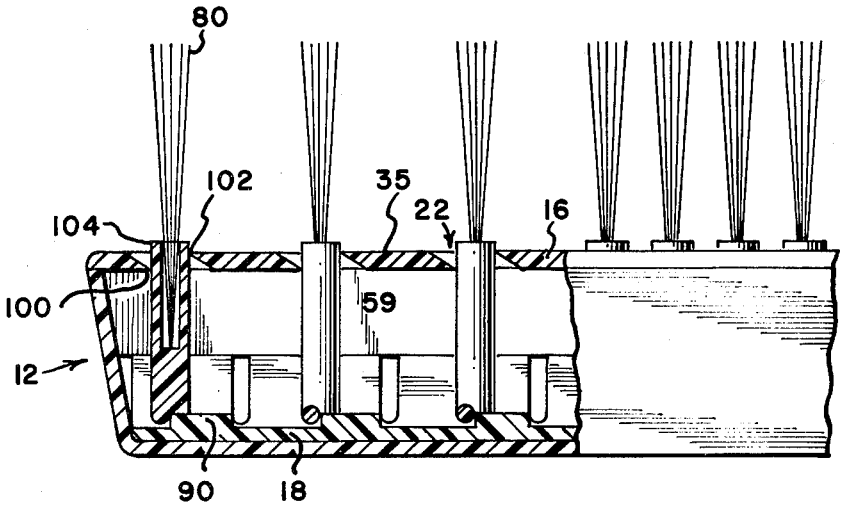
FIG. 8 is an enlarged partial sectional view, similar to FIG. 4, of another embodiment of the invention.

A second embodiment of the invention is illustrated in FIG. 8 of the drawing wherein the apertures 22 are provided in a somewhat different configuration. In this embodiment the apertures in the top wall 16 are through troughs having a generally circular configuration in cross section, but positioned at an acute angle with respect to the top surface 35 of top wall 16, thereby to form an angular trough through the top wall of the brush casing. In addition, in this form of the invention bristle holders 59 are somewhat elongated and are dimensioned to fit through the apertures 22 in their erect or vertical position, as seen in FIG. 8. With this arrangement, the troughs or openings 22 form a generally circular through passage when the top 16 is viewed in plan. This circular passage has a diameter which is slightly greater than the diameter of sleeves 59 so that the sleeves can extend therethrough. In this manner each opening 22 defines a lower edge portion 100, having a generally semi-circular configuration which is adapted to engage against the side of the sleeve 59 and an upper edge portion 102 which is adapted to engage against the opposite side of the sleeve.

In the retracted position of the carrier 18, which operates in the same manner as the carrier previously described, the free ends 80 of the bristles in the bristle holders 59 reside within openings 22 and as the carrier is moved towards its first or erecting position the sides of the openings guide the bristles and cause the sleeves to pivot. As the sleeves pivot their upper ends 104 enter the openings 22, and pass therethrough, until their vertical position, as defined by the abutments 90, is achieved. In this position the sleeve is relatively rigidly held and supported by the edges 100, 102 of the opening, so that the brush has a natural feel when in use, with the bristles rigidly supported at or adjacent the surface of the brush. Moreover, this arrangement substantially reduces wear on the bristles during extension and retraction.

Accordingly it is seen that a very compact portable pocket brush has been described which includes a simple movable mechanism for selective extension and retraction of bristle groups through the brush case. This mechanism requires a minimum number of parts and the cooperation between the configuration of the case and the bristle holders is such that the bristles are rigidly supported during use in their extended position above the top surface of the brush case. At the same time the brush provides a self-cleaning feature when the bristles are retracted.

Although illustrative embodiments of the invention have been described herein with reference to the accompanying drawings, it is to be understood that the invention is not limited to those precise embodiments, but that various changes and modifications may be effected therein by one skilled in the art without departing from the scope or spirit of this invention.

What is claimed is:

1. A brush construction comprising a hollow casing defining an internal cavity and having a top wall along one side of said cavity; said top wall having a predetermined array of openings formed therein; a slide plate slidably mounted in said cavity below and spaced from said top wall for sliding movement between first and second positions; a plurality of brush elements in said cavity respectively associated with said openings; each of said brush elements including a brush portion having a free tip end and an opposed mounting end and a mounting sleeve secured to the mounting end of the brush portion and pivotally mounted on said slide plate; each of said brush elements having a central axis and being located on said plate in the first position thereof, with the portion of their respective mounting sleeves connected to the slide plate offset from their associated openings, with the central axis thereof at an acute angle to the general plane of said top wall, and with said free tip ends thereof located within their associated openings; and in the second position of the slide plate with the portion of their respective mounting sleeves connected to the slide plate located substantially directly below their associated openings, with the central axis of the brush elements extending generally perpendicularly to the slide plate whereby the brush portions thereof extend through said openings and with a portion of their respective sleeves located within its associated opening in the top wall; said openings in said top wall having a predetermined peripheral configuration selected to closely surround said sleeves in the second position of the slide plate whereby the sleeves are supported about their entire periphery when the brush is operative, and wherein each of said openings being inclined in said top wall along an acute angle with respect to the plane of the top wall in generally the same direction as the angle of the central axis of the brush elements to the plane of the top wall in the first position of said side plate, and wherein said top wall has upper and lower surfaces and said openings define peripheral edges about the openings in said surfaces, the peripheral edges of the respective openings in said surfaces being partly superimposed to define a through passage in said top wall extending generally perpendicularly to the top wall and dimensioned to receive the portion of the mounting sleeve adjacent the mounting end of its associated brush portion whereby said sleeve is peripherally supported against movement in the second position of said slide plate.

2. A brush construction comprising a hollow casing defining an internal cavity and having a top wall along one side of said cavity; said top wall having a predetermined array of openings formed therein; a slide plate slidably mounted in said cavity below and spaced from said top wall for sliding movement between first and second positions; a plurality of brush elements in said cavity respectively associated with said openings; each of said brush elements including a brush portion having a free tip end and an opposed mounting end and a mounting sleeve secured to the mounting end of the brush portion and pivotally mounted on said slide plate; each of said brush elements having a central axis and being located on said plate in the first position thereof, with the portion of their respective mounting sleeves connected to the slide plate offset from their associated openings, with the central axis thereof at an accute angle to the general plane of said top wall, and with said free tip ends thereof located within their associated openings; and in the second position of the slide plate with the portion of their respective mounting sleeves connected to the slide plate located substantially directly below their associated openings, with the central axis of the brush elements extending generally perpendicularly to the slide plate whereby the brush portions thereof extend through said openings and with a portion of their respective sleeves located within its associate openings in the top wall; said openings in said top wall having a predetermined peripheral configuration selected to closely surround said sleeves in the second position of the slide plate whereby the sleeves are supported about their entire periphery when the brush is operative, and wherein each of said openings being inclined in said top wall along an acute angle with respect to the plane of the top wall in generally the same direction as the angle of the central axis of the brush elements to the plane of the top wall in the first position of said slide plate, and wherein said top wall has upper and lower surfaces and said lower surface has a plurality of pockets formed therein respectively located adjacent the end of the openings in the lower surfaces of the top wall and dimensioned to receive the portion of the mounting sleeve adjacent the mounting end of its associated brush portion whereby said sleeve is peripherally supported against movement in the second position of said slide plate.

3. A brush construction comprising a hollow casing defining an internal cavity and having a top wall along one side of said cavity; said top wall having a predetermined array of openings formed therein; a slide plate slidably mounted in said cavity belowe and spaced from said top wall for sliding movement between first and second positions; a plurality of brush elements in said cavity respectively associated with said openings; each of said brush elements including a brush portion having a free tip end and an opposed mounting end and a mounting sleeve secured to the mounting end of the brush portion and pivotally mounted on said slide plate; each of said brush elements having a central axis and being located on said plate in the first position thereof, with the portion of their respective mounting sleeves connected to the slide plate offset from their associated openings, with the central axis thereof at an acute angle to the general plane of said top wall, and with said free tip ends thereof located within their associated openings; and in the second position of the slide plate with the portion of their respective mounting sleeves connected to the slide plate located substantially directly below their associated openings, with the central axis of the brush elements extending generally perpendicularly to the slide plate whereby the brush portions thereof extend through said openings and with a portion of their respective sleeves located within its associated opening in the top wall; said openings in said top wall having a predetermined peripheral configuration selected to closely surround said sleeves in the second position of the slide plate whereby the sleeves are supported about their entire periphery when the brush is operative, and wherein said casing includes a bottom wall, opposite said top wall, having an elongated slot formed therein, said slide plate having a manually operable latch element formed thereon extending into said slot and said bottom wall and said latch element having cooperating means for latching said slide plate in said first and second positions thereof, and wherein said latch element comprises a resilient tongue formed on said slide plate having a protrusion formed thereon extending into said slot; and said cooperating means comprise at least one abutment formed on said protrusion extending transversely of said slot and first and second transverse recess formed along the periphery of said slot adapted to be selectively engaged with said abutments when the slide plate is moved between its first and second positions.

4. A retractable brush assembly comprising, a hollow casing having a first surface including a plurality of openings formed therein; a reciprocal carrier slidably mounted within said casing; a plurality of brush element supports pivotally mounted at spaced intervals along said carrier; a plurality of bush elements arranged at spaced intervals along said supports and having free ends, each bristle extending at least partially into an associated opening; said carrier including manually operable activating means accessible through said casing and slidable between first and second positions for moving said carrier relative to said casing in a first direction to cause said openings to rotate said brush supports in an erecting direction thereby moving said brush elements to an erect position so that the brush elements project through said openings, and in a second direction to cause said openings to rotate said brush supports in a collapsing direction, thereby moving said brush elements to a collapsed position wherein the brush elements are drawn into said casing and the free ends of the brush elements are at least flush with said first surface of the casing and within said openings; said openings in said first surface having predetermined peripheral configuration selected to closely surround a portion of said brush element supports in the first position of the carrier whereby the brush supports are supported by said first surface when the brush elements are in their erect position, wherein said openings are inclined in said first surface along an acute angle with respect to the plane of said first surface whereby in said collapsed position the brush elements lie within the casing at an acute angle with respect to said surface, and wherein said first surface comprises a top wall of the casing having upper and lower surfaces, and wherein said lower surface of the top wall has a plurality of pockets formed therein respectively located adjacent the end of the openings in the lower surface of the top wall and dimensioned to receive a portion of their associated brush element supports whereby said supports are peripherally supported against movement in their erect position.

5. A retractable brush assembly comprising, a hollow casing having a first surface including a plurality of openings formed therein; a reciprocal carrier slidably mounted within said casing; a plurality of brush element supports pivotally mounted at spaced intervals along said carrier; a plurality of brush elements arranged at spaced intervals along said supports and having free ends, each bristle extending at least partially into an associated opening; said carrier including manually operable activating means accessible through said casing and slidable between first and second positions for moving said carrier relative to said casing in a first direction to cause said openings to rotate said brush supports in an erecting direction thereby moving said brush elements to an erect position so that the brush elements project through said openings, and in a second direction to cause said openings to rotate said brush supports in a collapsing direction, thereby moving said brush elements to a collapsed position wherein the brush elements are drawn into said casing and the free ends of the brush elements are at least flush with said first surface of the casing and within said openings; said openings in said first surface having predetermined peripheral configuration selected to closely surround a portion of said brush element supports in the first position of the carrier whereby the brush supports are supported by said first surface when the brush elements are in their erect position, and wherein said casing includes a second surface opposite said first surface, said second surface having an elongated slot formed therein; and said manually operable activating means includes a manually operable activating means extending into said elongated slot for manually sliding the carrier between said first and second positions, and wherein said manually operable means includes a pair of opposed sidewalls extending into said slot; a pair of aligned and opposed abutments formed on said sidewalls in a direction substantially transverse to said second surface; and a first and second pair of aligned and opposed recesses formed along the periphery of said elongated slot; and first pair of recesses being adapted to engage said abutments when said carrier has been slidably moved to said first position in said first direction; said second pair of recesses being adapted to engage and retain said abutments when said carrier has been slidably moved to said second position in said second direction.

* * * * *